US009072654B2

(12) United States Patent
Pentz

(10) Patent No.: US 9,072,654 B2
(45) Date of Patent: Jul. 7, 2015

(54) MEDICATION REMINDER DEVICE

(71) Applicant: Edward Matias Pentz, Warminster, PA (US)

(72) Inventor: Edward Matias Pentz, Warminster, PA (US)

(73) Assignee: Argentum Creations LLC, Ivyland, PA (US)

( * ) Notice: Subject to any disclaimer, the term of this patent is extended or adjusted under 35 U.S.C. 154(b) by 54 days.

(21) Appl. No.: 14/063,258

(22) Filed: Oct. 25, 2013

(65) Prior Publication Data

US 2014/0125466 A1 May 8, 2014

Related U.S. Application Data

(60) Provisional application No. 61/723,087, filed on Nov. 6, 2012.

(51) Int. Cl.

| | |
|---|---|
| ***G08B 1/00*** | (2006.01) |
| ***A61J 7/04*** | (2006.01) |
| *A61J 1/16* | (2006.01) |

(52) U.S. Cl.

CPC . *A61J 7/0472* (2013.01); *A61J 1/16* (2013.01); *A61J 7/0481* (2013.01); *A61J 2205/20* (2013.01)

(58) Field of Classification Search

CPC .. G06F 19/3456; G06Q 10/109; G08B 21/24; G04F 1/005

USPC ..... 340/309.1, 309.16, 573.1, 309.3, 815.4, 340/309.7; 700/231, 240; 221/9

See application file for complete search history.

(56) References Cited

U.S. PATENT DOCUMENTS

| | | | | |
|---|---|---|---|---|
| 5,239,491 | A * | 8/1993 | Mucciacciaro | 702/177 |
| 7,359,765 | B2 * | 4/2008 | Varvarelis et al. | 700/237 |
| 8,319,613 | B2 * | 11/2012 | Lazar | 340/309.16 |
| 2001/0040500 | A1 * | 11/2001 | Weiner | 340/309.15 |
| 2006/0139150 | A1 * | 6/2006 | Brue | 340/309.16 |
| 2008/0168940 | A1 * | 7/2008 | Duer et al. | 116/324 |
| 2013/0035785 | A1 * | 2/2013 | MacVittie et al. | 700/231 |
| 2013/0195326 | A1 * | 8/2013 | Bear et al. | 382/128 |

* cited by examiner

*Primary Examiner* — Phung Nguyen

(74) *Attorney, Agent, or Firm* — Volpe and Koenig, P.C.

(57) ABSTRACT

A medication reminder device is provided. The device includes a housing that defines a recess for receiving a container. A diaphragm overlies the recess in the housing and is positioned for contact with a container positioned within the recess. The device includes a power supply and a switch that is connected to the power supply that responds to a presence of the container within the recess. A signal generator is connected to the power supply for activation when the container is present in the recess and emits a signal at a predetermined interval after activation.

19 Claims, 6 Drawing Sheets

MEDICATION REMINDER DEVICE

FIELD OF INVENTION

This invention is generally related to medication scheduling and more particularly related to a device that sets a reminder for taking medication.

BACKGROUND

Multiple methods and devices for reminding individuals to take medications are known. These known methods and devices typically do not actively remind an individual to take the medication. Pill boxes with multiple compartments organized by day or time do not provide a user with an active indication to take the medication. Other known medication reminder devices include complex features that are often difficult for individuals to properly use. These devices can often be very expensive depending on the complexity of the features, and failure to properly program the devices can result in missing medication doses or overdosing.

It is desired to provide an inexpensive, easy to use medication reminder device.

SUMMARY

The disclosed device includes a housing that defines a recess for receiving a container. A diaphragm is provided in the housing and is positioned for contact with a container positioned within the recess. The device includes a power supply and a switch that responds to a presence of the container within the recess. A signal generator is connected to the power supply for activation when the container is present in the recess and it generates a signal at a predetermined interval after activation.

Preferred arrangements with one or more features of the invention are described below and in the claims.

BRIEF DESCRIPTION OF THE DRAWINGS

The foregoing Summary as well as the following Detailed Description will be best understood when read in conjunction with the appended drawings. In the drawings.

DETAILED DESCRIPTION OF THE PREFERRED EMBODIMENTS

Figure 1:
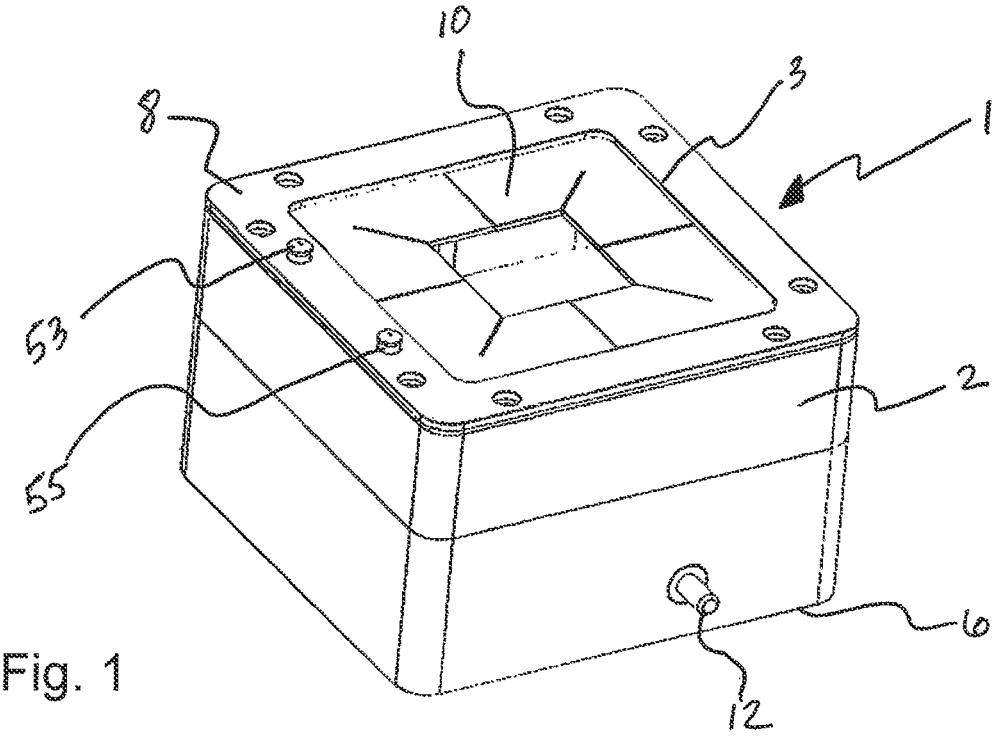
FIG. 1 shows a perspective view of a medication reminder device.
Figure 2:
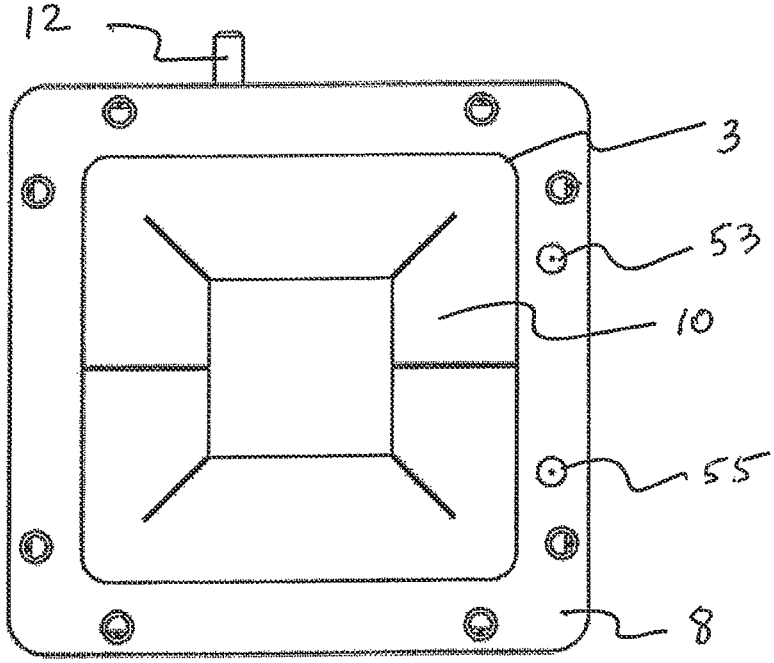
FIG. 2 shows a top planar view of the medication reminder device.

As shown in FIG. 1, the medication reminder device 1 includes a housing 2 that defines a recess 3 for receiving a container 100. In a preferred embodiment, a diaphragm 10 overlies the recess 3 in the housing 2 and is positioned for contact with the container 100 positioned within the recess 3. The housing 2 includes a base 6 and a top plate 8 that defines the recess 3. The diaphragm 10 is preferably comprised of a resilient material, like rubber or foam. FIG. 2 shows a top planar view of the diaphragm 10. In one embodiment, a resilient member is provided in the recess for contacting the container. The resilient member is preferably comprised of foam. In another embodiment, the container rests in the recess with no additional diaphragm or resilient member.

Figure 3:
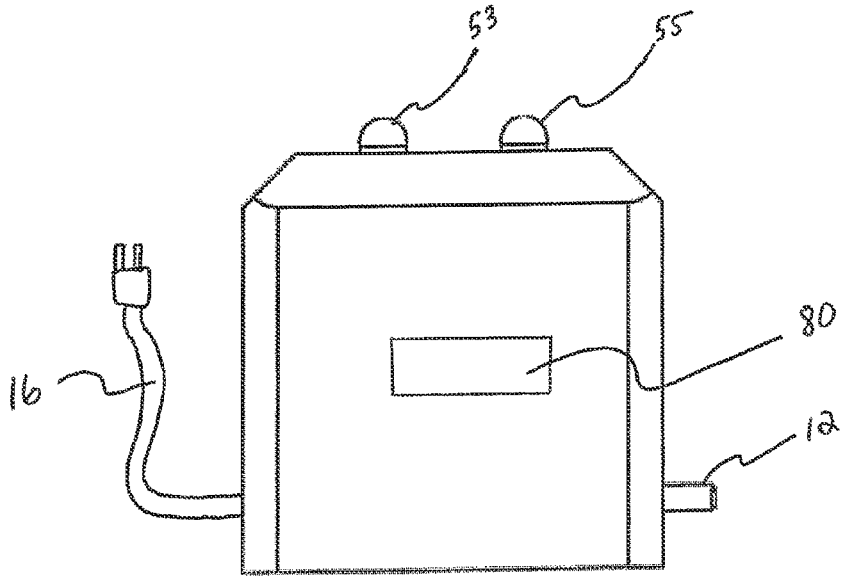
FIG. 3 shows a side planar view of the medication reminder device.
Figure 4:
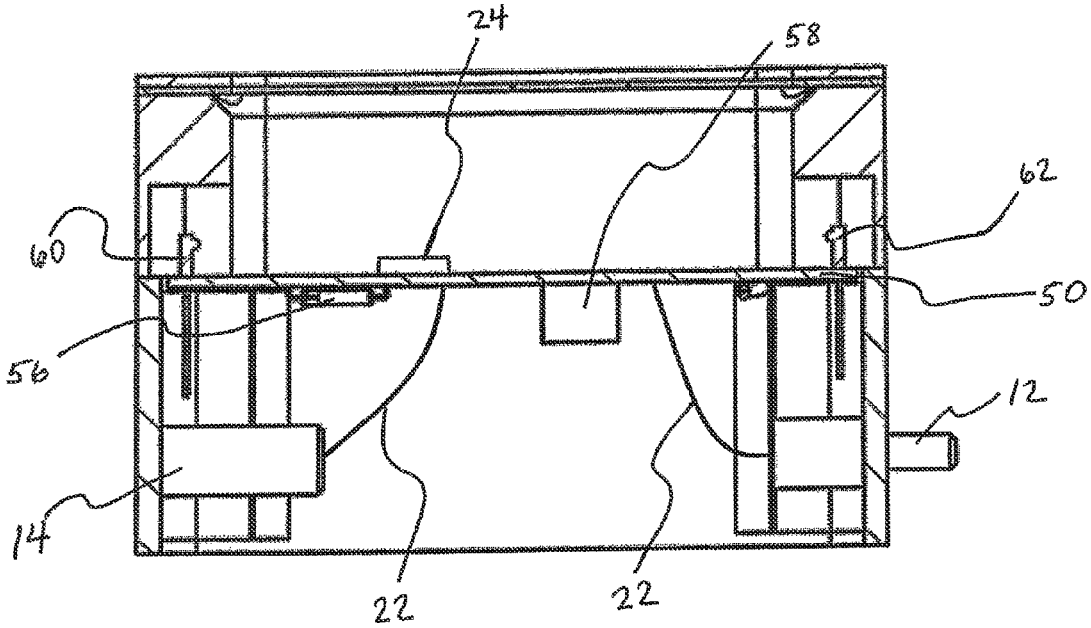
FIG. 4 shows a cross sectional view of the internal components of the medication reminder device.
Figure 5:
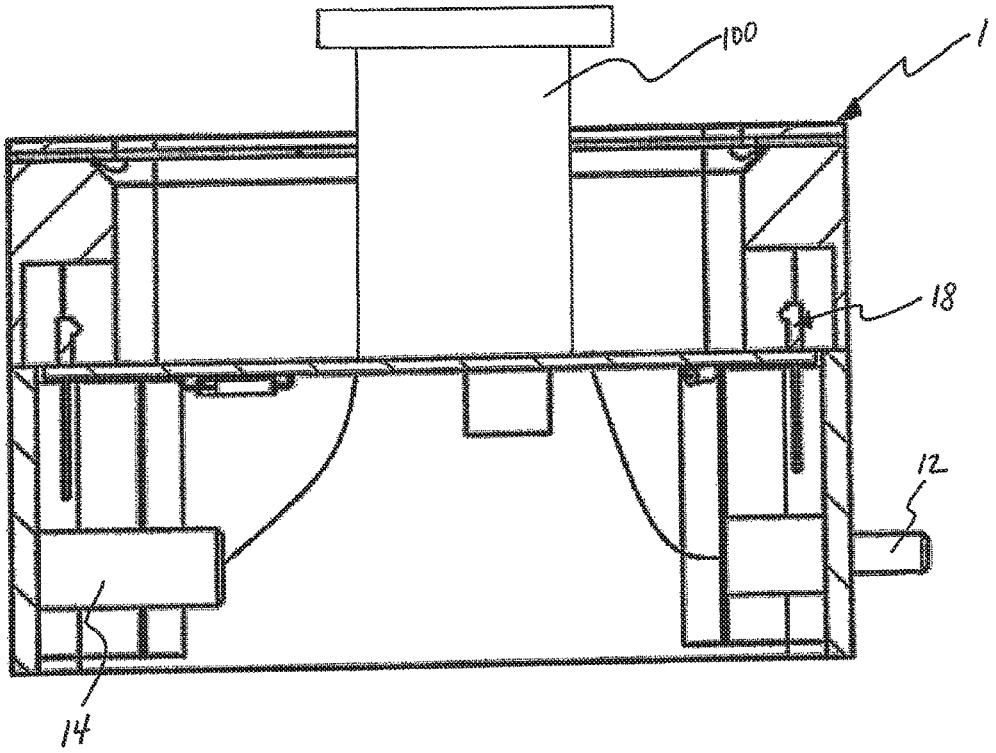
FIG. 5 shows a cross sectional view of the medication reminder device with a medication container.
Figure 6:
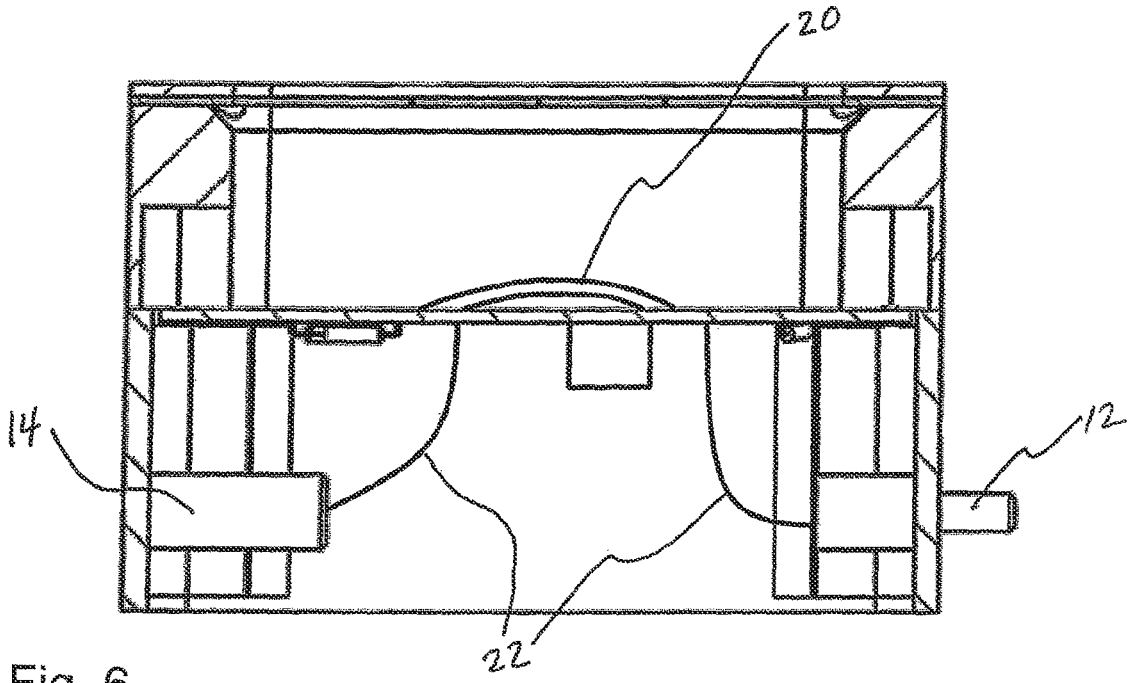
FIG. 6 shows a cross sectional view of the medication reminder device with a mechanical switch.
Figure 7:
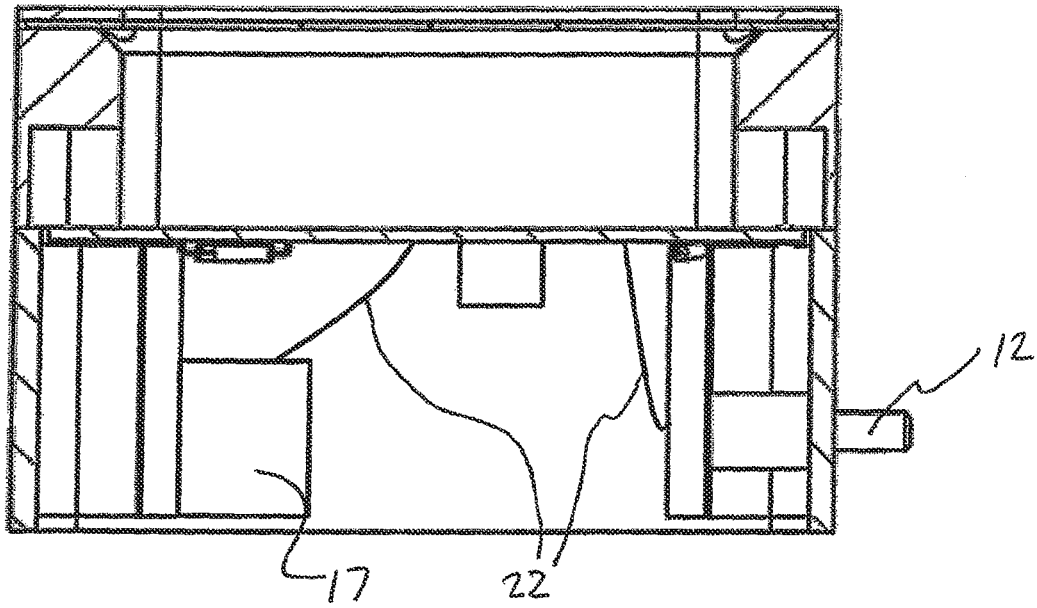
FIG. 7 shows a cross sectional view of the medication reminder device with a battery.

The device 1 includes a power supply. The power supply is preferably a battery 17, as shown in FIG. 7. In another embodiment, power is supplied by an AC power cord 16, as shown in FIG. 3. A switch that is connected to the power supply responds to a presence of the container 100 within the recess 3. The switch is preferably a photoelectric sensor 18, as shown in FIG. 5. The photoelectric sensor 18 can include a plurality of light sources and detectors 60, 62 located about the recess. Although only two components 60, 62 are shown for the photoelectric sensor, one of ordinary skill in the art recognizes that multiple light sources and detectors could be used. Alternatively, the switch is a mechanical push/pull switch 20, as shown in FIG. 6. The mechanical switch can include a pivot arm that is triggered by the container 100. Once the container 100 is positioned within the recess 3, the switch is activated, and power is supplied to a signal generator. The signal generator is connected to the power supply for activation when the container 100 is present in the recess 3 and it generates a signal at a predetermined interval after activation. In one embodiment, the signal generator comprises two lights 52, 54. The lights 52, 54 can be differentiated as a green light indicating medication should be taken, and a red light indicating medication should not be taken. In another embodiment shown in FIG. 4, the signal generator includes an audible alarm 24 or other sound indicating medication should be taken. The signal generator can be an LED display screen/control panel 80 that displays a variety of messages, including but not limited to a countdown indicating the remaining time until a medication should be taken. The LED display screen 80 can also display the name of the medication.

Figure 8:
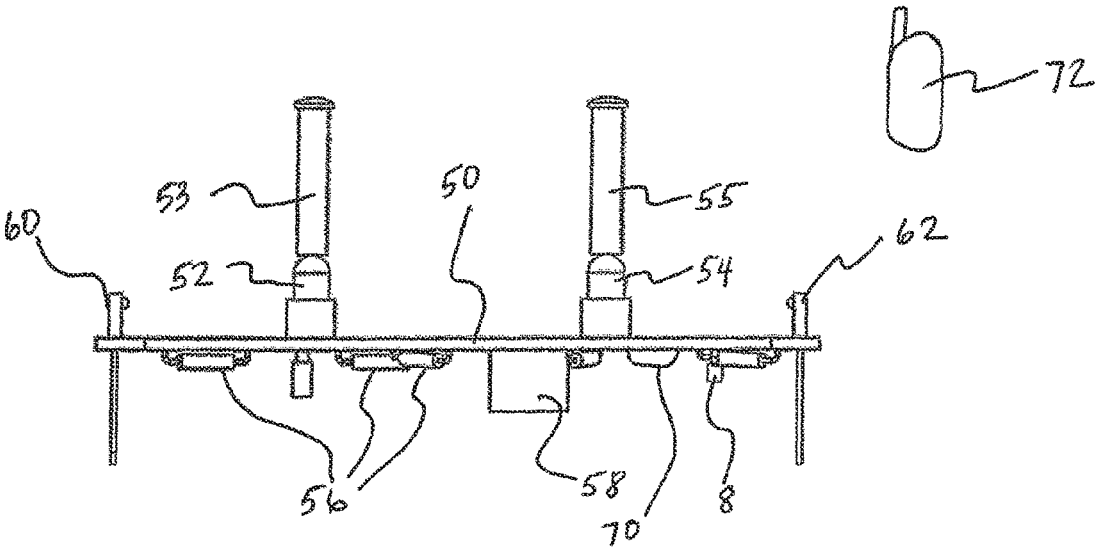
FIG. 8 shows a side planar view of a circuit board for the medication reminder device.
Figure 9:
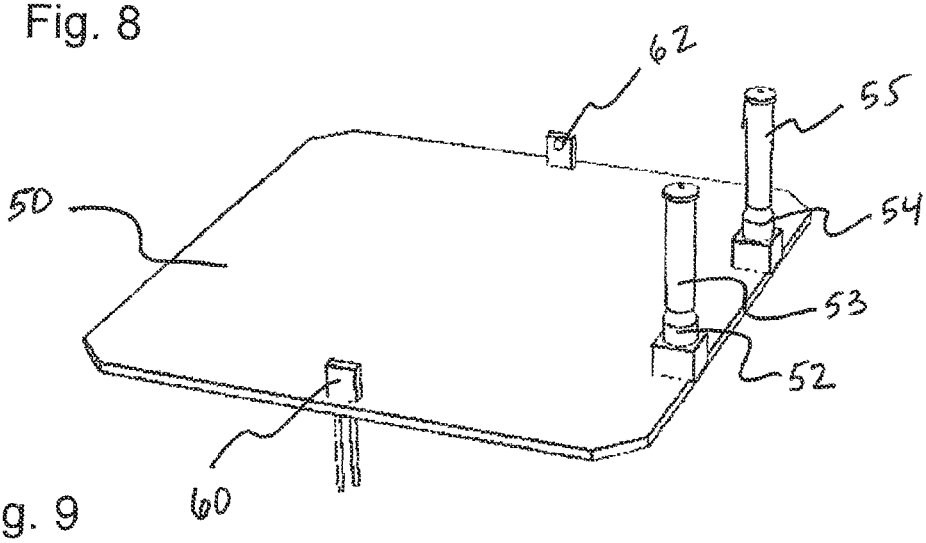
FIG. 9 shows a perspective view of the circuit board.

As shown in FIGS. 8 and 9, a circuit board 50 is provided for controlling the electric components of the device 1. The circuit board 50 preferably includes the signal generator 52, 54, a plurality of resistors 56, and the switch 60, 62. The signal generator preferably includes red and green LEDs that are attached to a clear tube 53, 55 that extends out of the housing 2. A memory chip 58 can also be provided for storing information. As shown in FIG. 3, a control panel or LED screen 80 can be provided for programming the memory and modifying the predetermined interval of the device 1. The control panel 80 can also control the settings for the signal generator, such as brightness of the lights, or volume of the alarm.

In another embodiment, the device 1 provides a static predetermined interval and lack any programmable components. In this embodiment, multiple variations of the device 1 can be provided, for example a device 1 with a four hour interval, a device with an eight hour interval, etc. Upon removal of the container 100 from the recess 3, the signal generator is deactivated. Once the container 100 is placed back into the recess 3, the signal generator is reactivated, and the predetermined interval begins again.

Figure 10:
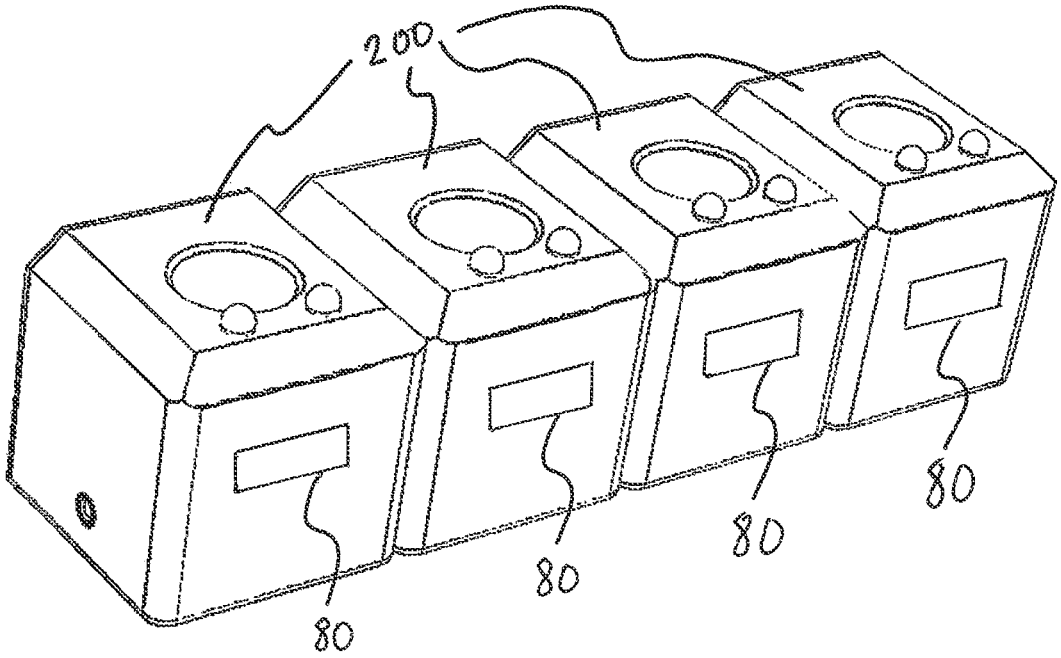
FIG. 10 shows a perspective view of a plurality of medication reminder devices.

In another embodiment shown in FIG. 10, a plurality of the medication reminder devices 200 are provided. In this embodiment, the devices 200 each include a control panel or LED screen 80 which can display the name of the medication.

In another embodiment, the devices 200 can be different colors or different colored elastic bands can be provided for the devices 200 to differentiate one from the other. The devices 200 are linked to each other via male and female connectors 12 and 14. A first one of the devices is connected to the AC power cord 16. Power is provided to the remaining ones of the devices via the connectors 12, 14. The devices 200 can communicate with one another via the connectors 12, 14. In another embodiment, the devices 200 can communicate with each other wirelessly via transmitters and receivers.

In another embodiment shown in FIG. 8, the circuit board 50 includes a wireless transmitter and receiver unit 70, such as a Bluetooth unit. A user can modify the timer settings of the device 1 via a wireless remote or cell phone 72.

What is claimed is:

1. A medication reminder device comprising:
a housing that defines a recess for receiving a container;
a diaphragm is positioned with respect to the recess so that it contacts a container positioned within the recess;
a power supply;
a switch that is connected to the power supply and responds to a presence of the container within the recess; and
a signal generator that is connected to the power supply for activation when the container is present in the recess and emits a signal at a predetermined interval after activation, wherein the housing includes a male connector and a female connector, and the female connector is configured to connect with both an AC power cord and a male connector of an adjacent modular medication reminder device.

2. The medication reminder device of claim 1, wherein the switch is a photoelectric sensor.

3. The medication reminder device of claim 1, wherein the switch is a mechanical switch.

4. The medication reminder device of claim 1, wherein the power supply is a battery.

5. The medication reminder device of claim 1, wherein the power supply is an AC power cord.

6. The medication reminder device of claim 1, wherein the signal generator comprises two lights, a first light that is green, and a second light that is red.

7. The medication reminder device of claim 1, wherein the signal generator comprises an audible emitting element.

8. The medication reminder device of claim 1, wherein the predetermined interval is four hours.

9. The medication reminder device of claim 1, wherein the predetermined interval is programmable.

10. The medication reminder device of claim 1, wherein the signal generator comprises an LED display screen configured to display a plurality of messages.

11. The medication reminder device of claim 1, wherein the power supply is a battery.

12. A medication reminder device comprising:
a housing that defines a recess for receiving a container;
a diaphragm is positioned with respect to the recess so that it contacts a container positioned within the recess;
a power supply;
a switch that is connected to the power supply and responds to a presence of the container within the recess; and
a signal generator that is connected to the power supply for activation when the container is present in the recess and emits a signal at a predetermined interval after activation, wherein a plurality of medication reminder devices are provided, and adjacent ones of the plurality of medication reminder devices are connected to each other via male connectors and female connectors.

13. A medication reminder device comprising:
a housing that defines a recess for receiving a container;
a retainer that is positioned to cooperate with respect to the recess and retain the container within the recess;
electrical connectors configured for connections with a power supply and a second medication reminder device;
a switch that is connected to the power supply and responds to a presence of the container within the recess; and
a signal generator that is connected to the power supply and emits a signal at predetermined intervals when the container is positioned within the recess.

14. The medication reminder device of claim 13, wherein the switch is a photoelectric sensor.

15. The medication reminder device of claim 13, wherein the switch is a mechanical switch.

16. The medication reminder device of claim 13, wherein the power supply is an AC power cord.

17. The medication reminder device of claim 13, wherein the signal generator comprises two lights, a first light that is green, and a second light that is red.

18. The medication reminder device of claim 13, wherein the signal generator comprises an audible emitting element.

19. The medication reminder device of claim 13, wherein the predetermined interval is programmable.

* * * * *